United States Patent [19]

Kydd

[11] Patent Number: 4,934,283

[45] Date of Patent: Jun. 19, 1990

[54] SOLID WASTE DISPOSAL UNIT

[75] Inventor: Paul H. Kydd, Lawrenceville, N.J.

[73] Assignee: Partnerships Limited, Inc., Lawrenceville, N.J.

[21] Appl. No.: 404,790

[22] Filed: Sep. 8, 1989

[51] Int. Cl.[5] ..... A47D 36/00; A47D 36/24

[52] U.S. Cl. ..... 110/246; 110/229; 110/237; 110/247; 110/250; 110/258; 110/346

[58] Field of Search ..... 110/246, 247, 237, 346, 110/229, 250, 258

[56] References Cited

U.S. PATENT DOCUMENTS

| | | | |
|---|---|---|---|
| 3,639,111 | 2/1972 | Thomas . | |
| 3,788,243 | 1/1974 | Eff . | |
| 4,255,590 | 3/1981 | Allen . | |
| 4,350,102 | 9/1982 | Ruegg . | |
| 4,399,756 | 8/1983 | la Clede Lientz . | |
| 4,759,300 | 7/1988 | Hansen et al. | 110/229 |
| 4,850,290 | 7/1989 | Benoit et al. | 110/237 X |

FOREIGN PATENT DOCUMENTS 65817 5/1980 Japan .

OTHER PUBLICATIONS

*Incineration of Hospital Infectious Waste;* Tessitore and Cross; Pollution Engineering; vol. XX, No. 11, pp. 83–88 (Nov. 1988).

*Burn or Not to Burn;* C. H. Marks; Pollution Engineering; vol. XX, No. 11, pp. 97–99 (Nov. 1988).

*Pyrolytic Processing of Organic Wastes;* K. A. Zeltner; Proceedings of the 37th Industrial Waste Conference; pp. 21–28 (1983).

*Innovative Thermal Processes for the Destruction of Hazardous Wastes;* H. Freeman; AIChE Symposium Series, Separation of Heavy Metals, No. 243, vol. 81 (1985).

*Primary Examiner*—Edward G. Favors

*Attorney, Agent, or Firm*—Mathews, Woodbridge & Collins

[57] ABSTRACT

A solid waste disposal unit having a lower, pyrolyzing chamber and an upper, oxidizing chamber separated by a movable plate. Waste is deposited in the lower chamber. The chambers are rotated to move the plate to a first position which seals the lower chamber from the entrance of air. While the chambers continue to rotate, a pair of heaters separately heats the chambers. The waste in the lower chamber is pyrolyzed in the absence of air and gives off a combustible vapor that in turn is oxidized in the upper chamber. A plurality of venturi jets, mounted in the movable plate, mix the vapor with air as the vapor passes into the upper chamber. Additional air is introduced into the upper chamber through a rotating regenerative heat exchanger recovering heat from the exhaust gases. After the waste is thoroughly pyrolyzed into a char, the rotation of the unit is reversed causing the movable plate to rotate into a new position wherein air is permitted to enter the lower chamber to cause oxidation of the char. This oxidation process continues until the char is entirely consumed and reduced to a sterile ash. Any gaseous products produced will continue to be oxidized in both chambers.

32 Claims, 10 Drawing Sheets

PYROLYSIS MODE

OXIDATION MODE

SOLID WASTE DISPOSAL UNIT

BACKGROUND OF THE INVENTION

1. Field of the Invention

The present invention relates to a solid waste disposal apparatus and, more particularly, to an apparatus to be used for the on-site disposal of waste material at the source where it is generated rather than in a large, central facility.

2. Description of the Related Art

The disposal of infectious clinical laboratory waste has become a major problem. In coastal areas, for example, improper waste disposal has recently caused major disruptions on beaches. The disposal of hazardous chemical laboratory wastes has been controlled by regulations for a number of years. Most regulations require that such waste be disposed of under a manifesting system wherein responsibility for the waste is clearly defined at all stages of its progress from the source to the ultimate disposal destination, either in an incinerator or in a certified hazardous waste landfill. Similar regulatory approaches are in the process of being implemented in a number of locations for infectious medical wastes in response to the disposal problems recently encountered.

A significant portion of medical wastes, particularly those from hospitals, are often disposed of in on-site incinerators. Some of these devices are in compliance with applicable codes, others are questionable or clearly noncompliant. Most smaller laboratories, such as independent clinical laboratories, contract with licensed hazardous waste haulers who move the material to an off-site central incinerator facility and dispose of it under certified conditions.

The magnitude of the waste disposal problem can be judged from the fact that the total of so called "Regulated Medical Waste" generated nationwide is reported to be approximately 700,000 tons per year. The cost of disposal by off-site hauling has been approximated to be $1,250.00 per ton for a total cost of $850,000,000.00 nationwide. These "Regulated Medical Wastes" include the following:

- Cultures and stocks of infectious agents and associated biologicals, including specimen cultures, culture dishes and related devices, biological production wastes, and discarded live and attenuated vaccines.
- Bulk blood, blood products, and body fluids.
- Pathological wastes, such as tissues, organs, body parts, products of conception.
- Needles, syringes, intravenous tubing with needles attached, vacuum collection containers and tubes containing blood and blood products.
- Carcasses, body parts and bedding of research animals exposed to pathogens.
- Waste from rare or unusual cases of communicable diseases.

Almost as serious a problem in urban areas is the disposal of household solid wastes. These, while nonhazardous and not requiring the extreme care in manifesting and maintenance of responsibility as required for hazardous and infectious waste, require disposal either in landfills or incinerators, procedures that are encountering serious difficulties in many locales. Landfills are by far the least expensive alternative; but landfills in most urban areas are being exhausted and shut down continually and new landfill sties are often opposed by the local residents. Incinerators are viewed as being extremely expensive to build and operate and are opposed, if anything, even more vigorously by the local residents. A disposal solution that has been adopted frequently has been to transport waste further and further from the source of origin into neighboring areas, and as a consequence, disposal costs have increased.

As such, the on-site disposal of solid waste has been recognized by many as a promising solution to most of the aforementioned disposal problems. Many of the cost factors associated with transporting and tracking the waste are reduced significantly. Also, expensive landfill capital and operating costs are virtually eliminated. Although those concerned with the development of waste disposal equipment have long recognized the need for an on-site apparatus for general use, no practical, economic device has yet been proposed. The requirements which such a device must meet are:

a. simplicity in operation comparable to a household appliance
b. substantially free from air emissions
c. ability to handle a wide range of waste material including paper, liquids and plastics including chlorinated plastics
d. maximum reduction in mass and volume of the waste. Although requirement d can only be met by thermal destruction of the waste, requirements a, b and c together rule out conventional incinerator approaches based on burning waste with air. Even more sophisticated two stage incinerators in which the waste is burned with deficient air, and the combustion gases are afterburned in a secondary chamber, cannot meet the requirements.

Commercial pyrolysis waste disposal systems have been available for some years as indicated in Zeltner, K.A.; *Pyrolytic Processing of Organic Wastes*; Proceedings of the 37th Industrial Waste Conference, pp. 21–18 (1983). These devices are usually large industrial units, custom designed for each application, and the number of installations so far is limited. Pyrolysis occurs in these devices on a rotary hearth direct fired with stoichiometric gas-air burners to provide an approximately oxygen-free atmosphere. No attempt is made to combust the carbon in the residue which is discharged directly with a reduction in mass relative to the feed of 80%.

Typical hospital incinerator systems, described by Tessitore and Cross; *Incineration of Hospital Infectious Waste*; Pollution Engineering, Volume XX, Number 11, pp. 83–88, November 1988, and Marks, C. H.; *Burn or Not to Burn: The Hospitals' Modern-Day Dilemma*; Pollution Engineering, Volume XX, Number 11, pp. 97–99, November 1988, operate on the controlled air principle in which the primary combustion chamber operates with deficient, but not zero, air to reduce particulate emissions, and the gases are burned to completion in an after-burner. In this type of incinerator the combustible content in the ash can be reduced by 5%, but with significant fly ash emissions. The same principle is used in modern wood stoves.

Nine innovative thermal destruction approaches have been described in Freeman, H.; *Innovative Thermal Processes For The Destruction of Hazardous Wastes*; AIChE Symposium Series, Separation of Heavy Metals, No. 243, Vol. 81 (1985), including approaches in which heat was transferred to the incoming solid refuse by a molten salt and molten glass. None of these techniques have achieved commercial acceptance nor are any of them suitable for the present application.

U.S. Pat. No. 3,639,111 of David L. Brink and Jerome F. Thomas discloses a system for pyrolysis of black liquor from the Kraft process with sequential pyrolysis chambers in which the waste was heated first indirectly and then directly. A controlled amount of air was introduced into the pyrolysis zone to achieve the requisite cracking temperature. The process is complex and specialized.

Mitsui Engineering and Shipbuilding patented in Japan (Japanese Patent No. 80/65,817) a system for radioactive wastes in which the wastes were indirectly heated to thermal decomposition followed by combustion of the pyrolysis vapors to completion. The method was described as applicable to both continuous and batch operation and was reported to produce little dust. Mitsui's patent recites application of their process to ion exchange resins and other polymers, paper, cloth and wood. The process is potentially applicable to on-site destruction of waste, but it has no provision for completely combusting the carbonized residue to an ash.

Pyrolysis is particularly applicable to the destruction of wastes containing halogens such as Cl and Br. Pyrolysis and incineration of difficult to combust organic residues is disclosed in U.S. Pat. No. 4,255,590 of John K. Allen. This patent recites pyrolysis in a fluid bed of sand fluidized by nitrogen followed by incineration of the off-gases. After removing condensable hydrocarbons, halogen acids are absorbed by a carbonate, hydroxide, or oxide of calcium and magnesium. This process was invented to dispose of waste from the manufacture of benzene di- and tri-carboxylic acids. It is not suitable as an on-site approach in that it is a complex, continuous process carried out in a fluid bed which is notoriously difficult to control and operate.

Pyrolyzing polyvinylchloride plastic to avoid formation of phosgene is described in U.S. Pat. No. 4,399,756 to la Clede Lientz. This process is also continuous and also introduces deficient air into the pyrolysis zone which restricts the types of waste that can be handled.

In U.S. Pat. No. 3,788,243 of Christian A. Eff, an incinerator for domestic refuse is described. This device heats the partially combusted gases from incomplete combustion of waste electrically with addition of excess air to complete combustion. It shows some of the batchwise electrically heated features needed in an on-site device. This device is likely to have significant air emissions. Also, it is limited in the types of waste material it can handle because the waste material is used as the fuel.

In U.S. Pat. No. 4,350,102 of Hans Ruegg, there is disclosed a system wherein the generation of combustible gas is controlled by controlling the heat input to the pyrolysis section. In this case, however, heat input is controlled by admitting or not admitting air for combustion to the pyrolysis chamber manually. This device is, therefore, complex to operate and the types of waste material it can handle are limited.

As can be seen from these descriptions of prior art disposal apparatus, there is an unmet need for a practical on-site disposal device of general utility. The present invention fulfills this need.

SUMMARY OF THE INVENTION

The general purpose of this invention is to provide a solid waste disposal unit which embraces all of the advantages of similarly employed prior art devices and possesses none of the aforedescribed disadvantages. To attain this, the present invention contemplates a unique solid waste disposal unit in which combustible solid wastes of all types are decomposed by first pyrolyzing them in the substantially complete absence of air while disposing of the vapors in a regenerative, electrically augmented oxidizer. The residual char is then oxidized in a subsequent operation to a sterile ash. Pyrolysis in the absence of air allows the process to be controlled automatically by the rate of heat addition to the pyrolysis chamber, independent of the combustibility or noncombustibility of the waste itself. This is a critical requirement for a system which must handle a wide range of waste materials in a simple, automatic, safe fashion. This heating is preferably done with an electric heater, but other means of heating are acceptable as long as they are external to the pyrolysis chamber and independent of the nature of the waste.

The vapors generated by pyrolysis must be oxidized to completion, again independent of their combustibility. This is most readily accomplished in an oxidation chamber directly adjacent to the pyrolysis chamber which can be designed to provide adequate air flow at a temperature and residence time sufficient to consume the flow of vapor which is controlled by the rate of heating of the pyrolysis chamber, as mentioned above.

Once pyrolysis is complete and the waste has been reduced to a non-volatile char, air is admitted to oxidize the residual char to a sterile ash. This sequential batch operation provides a simple, automatic approach to achieving maximum reduction of mass and volume while maintaining control of the process so as to consume virtually any type of waste material with minimum emissions to the atmosphere.

This disposal unit includes two chambers, a pyrolysis chamber into which waste is loaded and an adjacent vapor oxidation chamber. The chambers are physically rotated to permit the oxidation chamber to operate in a regenerative mode in which heat is recovered from the exit gases to preheat the incoming air via a refractory, regenerative heat exchanger. The rotation also breaks up the carbonizing charge in the pyrolysis chamber to improve heat transfer during the pyrolysis process and complete the desired volume reduction. After the pyrolysis process is complete, air is introduced into the pyrolysis chamber by reversing the rotation of the unit. At this point the unit automatically switches into an entirely aerobic mode to burn out the remaining fixed carbonaceous material left behind in the pyrolysis chamber. The vapors and gases resulting from this oxidation are still passed through the oxidation chamber to insure destruction of volatile organic materials, hydrogen and carbon monoxide. The oxidation process in the pyrolysis chamber continues until the char is entirely consumed and reduced to a sterile ash.

An object of the present invention is the provision of a solid waste disposal unit in which there is an initial pyrolysis of the waste in the substantially complete absence of air to produce a devolatilized char.

Another object is to provide a disposal unit wherein a previously pyrolysized char is oxidized into a sterile inorganic ash.

A further object of the invention is the provision of an oxidizer that is closely coupled to a pyrolysis unit wherein combustion of the vapors released during the pyrolysis process takes place in the oxidizer in a flameless process.

Still another object is to provide a disposal unit having an oxidizer in which oxidation of vapors is completed with a minimum production of soot and with maximum destruction of partially oxidized products of combustion.

Yet another object of the present invention is the provision of a disposal unit capable of performing a sequential pyrolysis-oxidation process on solid waste and wherein the method of switching from the pyrolysis mode to the oxidation mode is simple and reliable.

The exact nature of this invention as well as other objects and advantages thereof will be readily apparent form consideration of the following specification relating to the annexed drawings

DETAILED DESCRIPTION OF THE PREFERRED EMBODIMENT

Figure 1A:
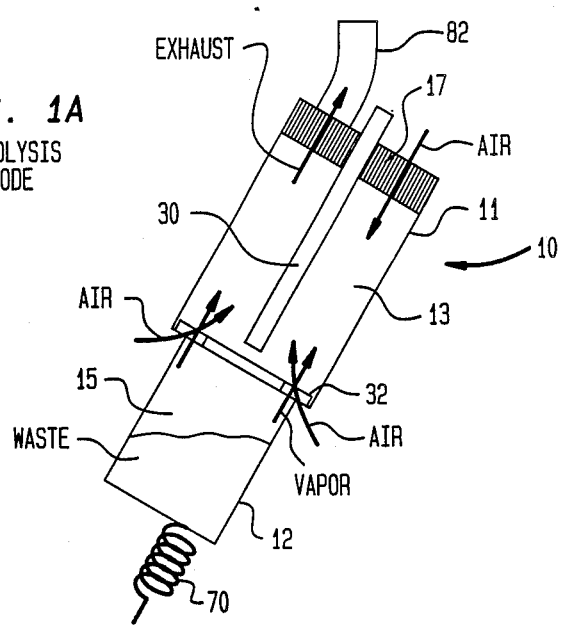
FIG. 1A shows a schematic view of the waste disposal apparatus in the pyrolysis mode.

Referring now to the drawings, wherein like reference characters designate like or corresponding parts throughout the several views, there is shown a disposal unit 10 having an oxidizer 11 and a pyrolyzer 12. The oxidizer 11 includes an oxidation chamber 13 defined by a cylindrical wall 14 covered at one end by a ceramic honeycomb 17 and at the other end by a stationary slotted plate 19. Wall 14 and plate 19 are attached to form a rigid structure. The exterior surface of wall 14 and the adjacent exterior side surface of honeycomb 17 are covered with a heat insulator 21 mounted in an outer cylindrical shell 23. The shell 23 is rigidly attached near one end to the edge of plate 19 and at the other end has a lateral wall 25 and a lip 27. The wall 25 extends over the insulator 21 and abuts the upper edge of honeycomb 17. Six radial slots 28 are symmetrically spaced on plate 19 to be located directly below the chamber 13. The honeycomb 17 has a central bore 29 to permit an electric heater rod 30 to extend into chamber 13.

Figure 7:
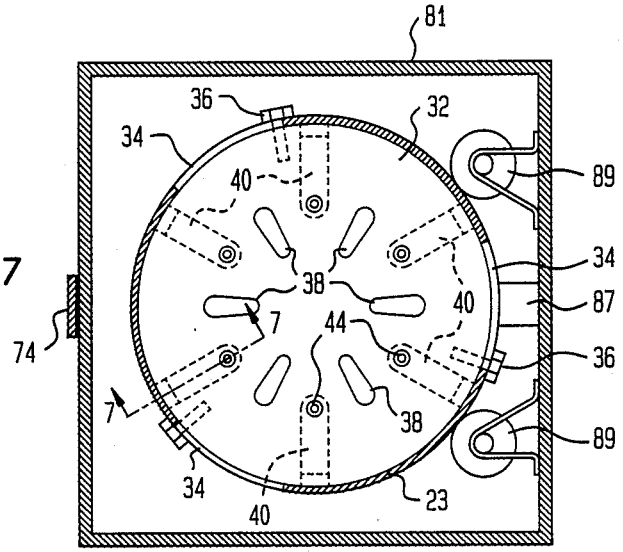
FIG. 7 is a cross section of the preferred embodiment taken on the line 7—7 of FIG. 3B looking in the direction of the arrows.
Figure 8:
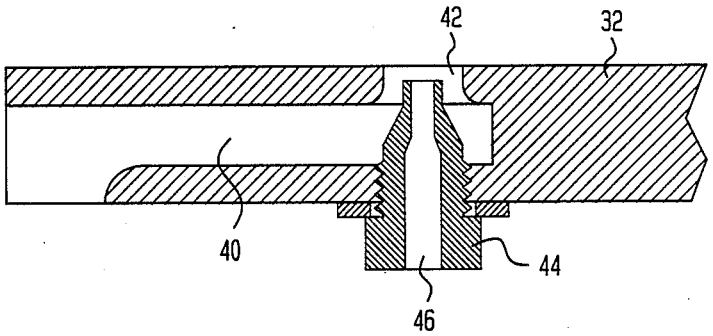
FIG. 8 is a cross section of the preferred embodiment taken on the line 8—8 of FIG. 7 and looking in the direction of the arrows.

A movable plate 32 is slidably mounted on the lower end of shell 23 in a position to permit the upper surface thereof to abut the lower surface of plate 19. The lower portion of shell 23 has three elongated circumferential slots 34 (FIGS. 3C, 3D, 7) that each receive one of the three bolts 36 which are threaded into the edge of plate 32. The plate 32 has six radial slots 38 that are each of the same size as slots 28 and are spaced about plate 32 in the same manner as slots 28 are spaced on plate 19. Also arranged on plate 32 are six radial slots 40 that are interlaced between the slots 28. As shown clearly in FIG. 8, each slot 40 extends from the lower outer edge of plate 32 radially inwardly to an opening 42 in the upper surface of plate 32. A metering jet 44 is threaded into the lower portion of plate 32 so that one end of jet 44 extends into the opening 42. Metering jet 44 includes a passageway 46 that extends from below the plate 32 to the opening 42. The six openings 42 are arranged on plate 32 at the same angular spacings as are the slots 28 on plate 19.

The pyrolyzer 12 includes a pyrolyzing chamber 15 defined by a cylindrical wall 51 and a bottom wall 53. A cylindrical insulator 55 covers the outside surface of wall 51. The chamber 15 and insulator 55 are fixed in a cylindrical shell 57 that is rigidly attached to the upper surface of a sprocket wheel 59 chain driven by a sprocketed gear-motor 60.

The upper periphery of the shell 57 has a plurality of spaced teeth 50 that are arranged to mate with similarly placed recesses 52 on the undersurface of plate 32.

The gear-motor 60 is mounted on a radial arm 62 of a drive platform 64. Four rollers 66 are mounted on drive platform 64. The undersurface of sprocket wheel 59 rests on the rollers 66. The chamber 15, insulator 55, shell 57 and sprocket wheel 59 are capable of being rotating by gear-motor 60 as a single unit with respect to platform 64.

An electric heater includes a heater coil 70 mounted on a ceramic base 72 that is fixed to the platform 64 by a threaded collar 56 which is integral with the undersurface of base 72. A nut mates with the threaded collar 56 to secure the heater in a central opening in the platform 64.

A stirrer 73, having a weighted base that supports three posts, is loosely placed in the chamber 15 with the base resting on the bottom wall 53. The stirrer 73 is free to move about in chamber 15 during operating of the gear-motor 60.

Figure 2:
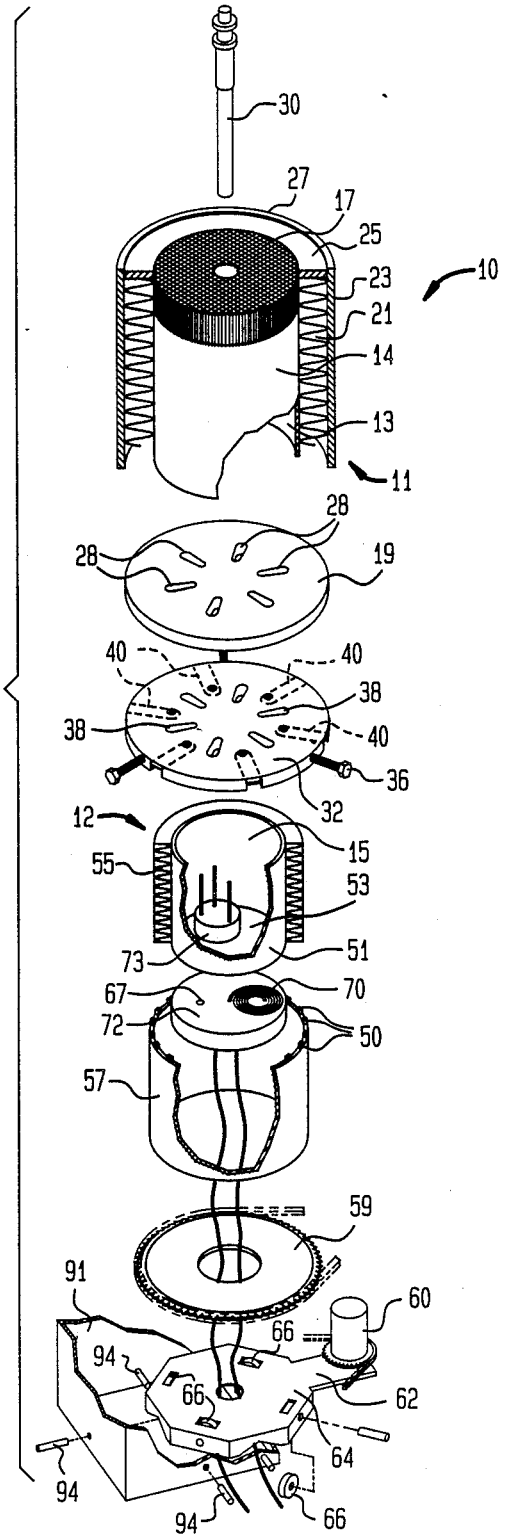
FIG. 2 shows an exploded, pictorial view, partly in section, of a preferred embodiment of the invention.

As shown in FIG. 2, a fixed upper shroud 81 is supported at an angle on a movable carriage 83 by an inclined arm 85. A ledge 87 is fixed to the inside surface of shroud 81 near the upper end of arm 85. Rollers 89 are fixed to the inside surface of shroud 81.

The oxidizer 11 is placed in the shroud 81 in a position such that the lower edge of shell 23 is supported on the ledge 87 and the outer cylindrical surface of shell 23 is supported on the rollers 89. A manifold plate 100 has a circular support seal 102 that slidably bears on the upper surface of wall 25 just inside the lip 27. Cover plate 100 includes a plurality of air inlet openings 84 and a plurality of exhaust openings 86. A fan-shaped chamber (FIG. 4) is formed by a seal 88 depending from the undersurface of plate 100 into close proximity with the upper surface of honeycomb 17. An exhaust duct 82 passes through the upper wall of shroud 81 and is connected to a fitting 80 that communicates with the openings 86. The heater rod 30 is held in a central opening in the plate 100 and extends through the bore 29 of honeycomb 17 into the chamber 13. An exhaust fan 78 (FIG. 3A) communicates with duct 82 to draw air through chamber 13.

The oxidizer 11 and the plate 100 resting thereon are free to slide upwardly along a line parallel to arm 85. To accommodate this movement, the duct 82 and fitting 80 are free to move up with plate 100. Also, when driven by the pyrolyzer 12 in a manner to be described later in detail, the oxidizer 11 is free to rotate while being partially supported on the rollers 89. During this rotation, the plate 100 is held stationary by its edge that rests against the inside surface of the shroud 81 just above the uppermost rollers 89.

A lower shroud 91, having four side walls, a bottom wall and an open top, houses the pyrolyzer 12. Each of the four side walls, near the lower portion of the shroud 91, has a support pin 94 fixed thereto. The drive platform 64 has four inverted V-shaped ramps 65 that are normally positioned on the pins 94. The pins 94 and rollers 89, mounted on the inside surface of shroud 91, support the pyrolyzer 12.

The shroud 91 also has a double stepped slot 95 having shoulders 96, 97 (FIG. 9) in one of the side walls. Arm 62 extends through slot 95 to support gear-motor 60 exterior of shroud 91. The shroud 91 is pivotably supported on the wheeled carriage 83 by axle 71 and coil springs 70 for permitting the shroud 91 to rotate about an axle 71. Springs 70 normally hold the shroud 91 up in the position shown in FIG. 3B so that the teeth 50 will mate with the recesses 52.

A foot pedal 75 is fixed to the exterior surface of shroud 91. As such, the shroud 91 is manually pivotable between a first, open position (FIG. 3A), wherein waste material may be placed in chamber 15, and a second, operating position (FIG. 3B), wherein the shroud 91 is supported by springs 70. A latch 74 is provided for locking the disposal unit 10 in the operating position shown in FIG. 3B.

Figure 1B:
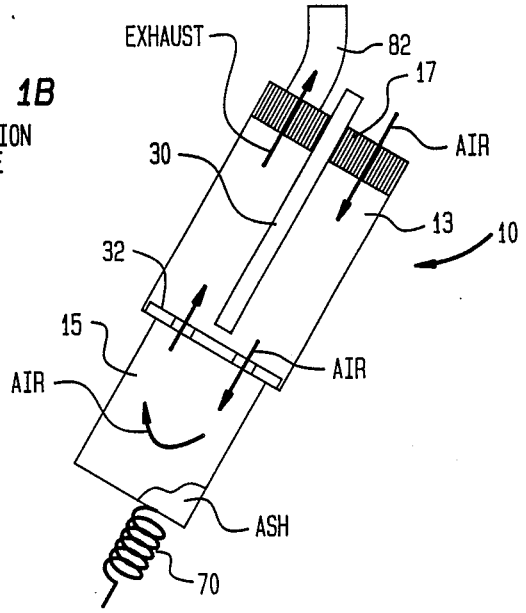
FIG. 1B shows a schematic view of the waste disposal apparatus in its oxidation mode.

In general terms, the basic operating principle of the disposal unit 10 begins with an initial pyrolysis of waste products placed in the chamber 15 as shown in FIG 1A. This pyrolysis process is conducted in the substantially complete absence of air to produce a devolatized char. This pyrolysis step is followed by an oxidation step shown in FIG. 1B in which air is introduced into the chamber 15 to completely oxidize the char to a sterile inorganic ash. Meanwhile, the vapors generated during the pyrolysis and oxidation processes are passed from the chamber 15 into the chamber 13 of the oxidizer 11 where they are oxidized.

The pyrolyzer 12 and the oxidizer 11 contain their own heaters, i.e., coil 70 and heater 30, respectively, to produce the proper temperatures independent of the combustibility of the waste so that the disposal unit 10 can operate on any type of waste ranging from water to gasoline. Although gas heating could be used in either the pyrolyzer 12 or oxidizer 11, electric heaters are preferred for convenience.

Figure 3A:
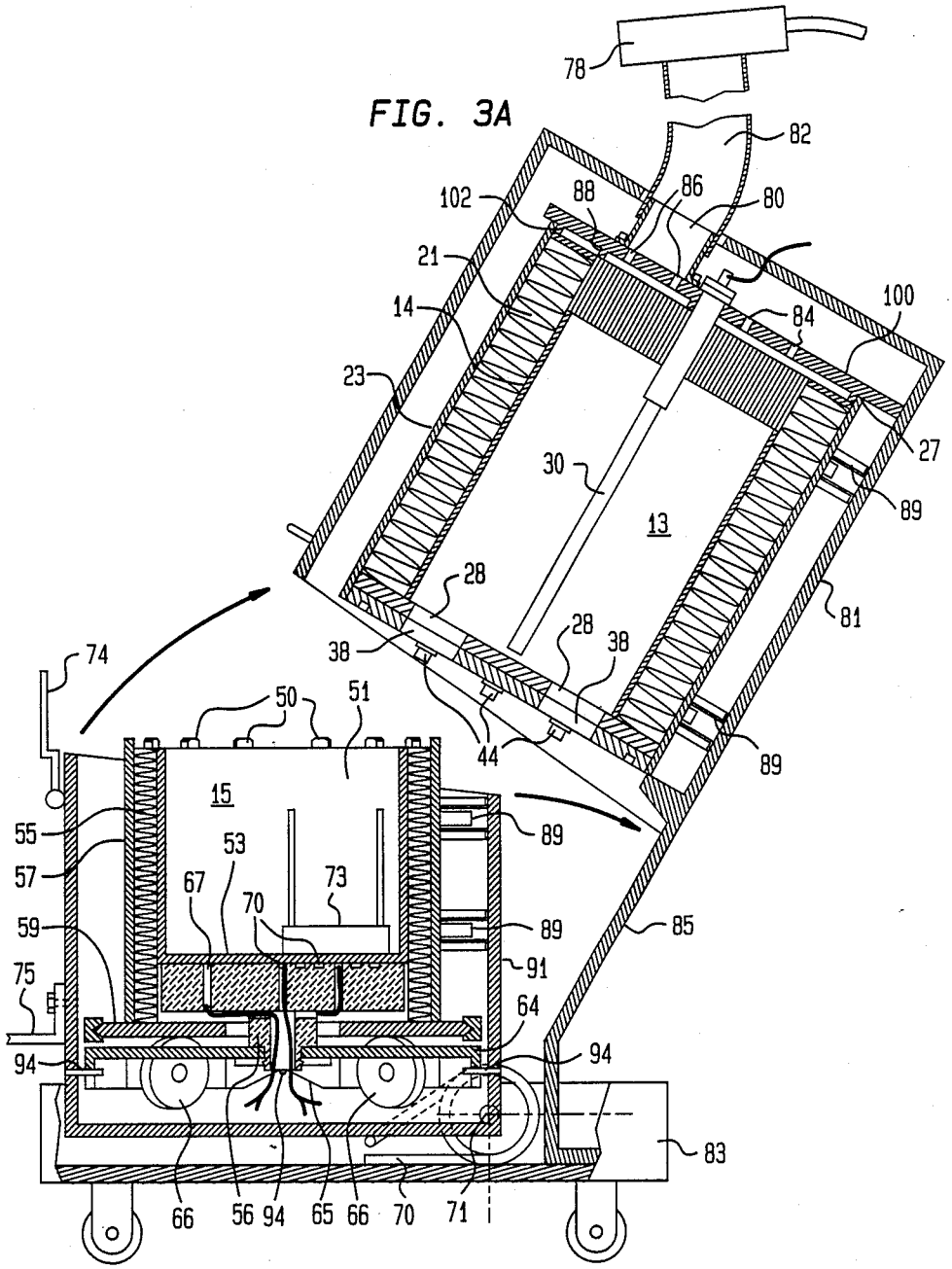
FIG. 3A-3D shows elevations, partly in section, of the device shown in FIG. 2 depicting its various stages of operation.
Figure 4:
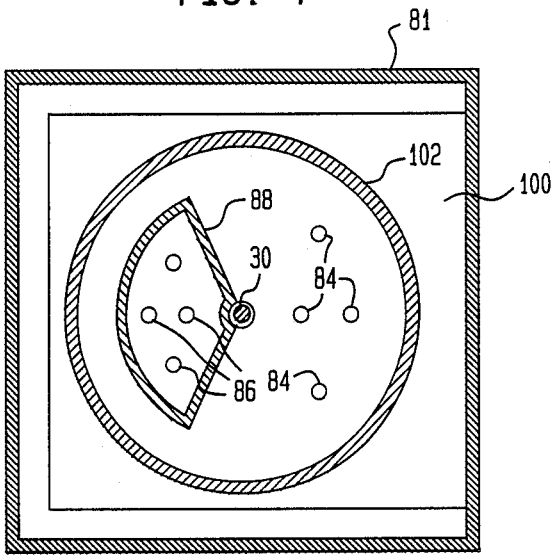
FIG. 4 is a cross section of the preferred embodiment taken on the line 4—4 of FIG. 3B looking in the direction of the arrows.
Figure 5:
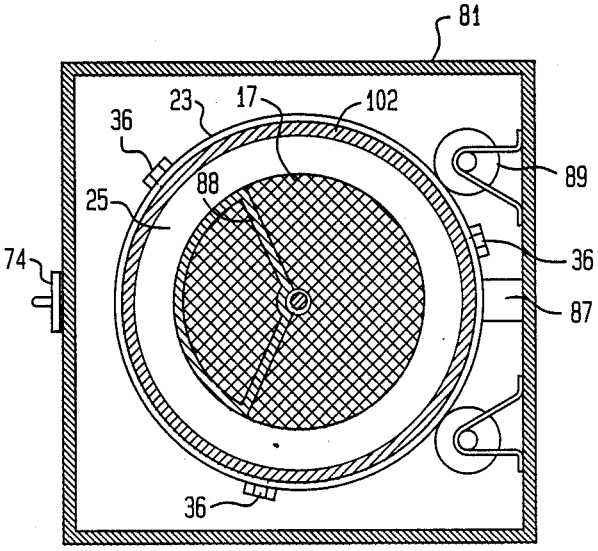
FIG. 5 is a cross section of the preferred embodiment taken on the line 5—5 of FIG. 3B looking in the direction of the arrows.

Operating of the device starts by first stepping on foot pedal 75 to lower the shell 91 to the position shown in FIG. 3A. Waste materials are then loaded into the chamber 15. The shell 91 is then raised by spring 70 to be held in the position shown in FIG. 3B. The latch 74 is next secured to prevent inadvertent opening of the pyrolysis chamber 15 while operating. Next the heater rod 30 is energized by an electrical power source (not shown) for a time period sufficient to heat the chamber 13 to an operating temperature wherein combustible vapors enter chamber 13 are oxidized. Once the chamber 13 reaches operating temperature, electrical power is then applied to heater coil 70 to heat the chamber 15 to a level which will cause pyrolysis of waste material therein to begin. Also at this time, the gear-motor 60 is energized to drive the sprocket wheel 59 counterclockwise as viewed in FIG. 9. Additionally, the exhaust fan 78 is turned on to drawn exhaust fumes from the chamber 13 through that portion of the honeycomb 17 that lies below the fan-shaped chamber formed by seal 88 (FIGS. 4, 5).

Figure 3B:
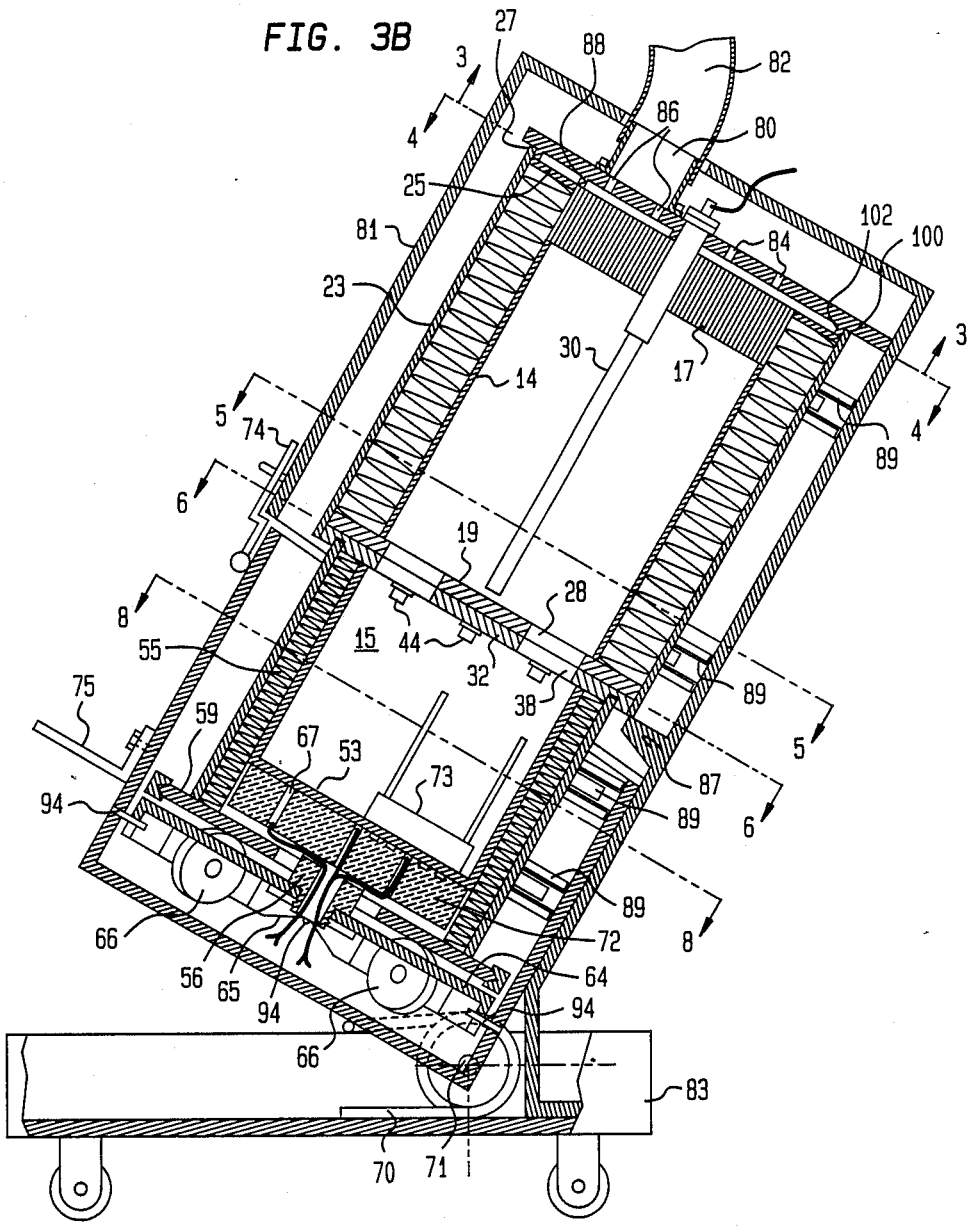

Just before the gear-motor 60 is energized, the oxidizer 11 is generally in the position shown in FIG. 3B. In this position, the weight of the oxidizer 11 is supported by the rollers 89 in shroud 81 and the ledge 87. Also at this point, the spring 70 is biasing the pyrolyzer 12 up against the oxidizer 11 with the teeth 50 on the upper periphery of shell 57 meshed with the recesses 52 on the undersurface of plate 32. The weight of the rotating pyrolyzer 12 will be supported by the rollers 66 on drive platform 64 and the rollers 89 on the inside surface of shroud 91. With the gear-motor 60 energized, the sprocket wheel 59, the shell 57, insulator 55 and chamber 15 will all rotate as a unit on rollers 66 and 89. The heater, comprising coil 70 and base 72, is fixed to platform 64 and, therefore, will not rotate with the chamber 15. The stirrer 73 will tumble and slide in the chamber 15 as it rotates, thereby stirring and mixing the waste contents therein. This stirring action is particularly important during the oxidation stage in chamber 15.

Figure 3C:
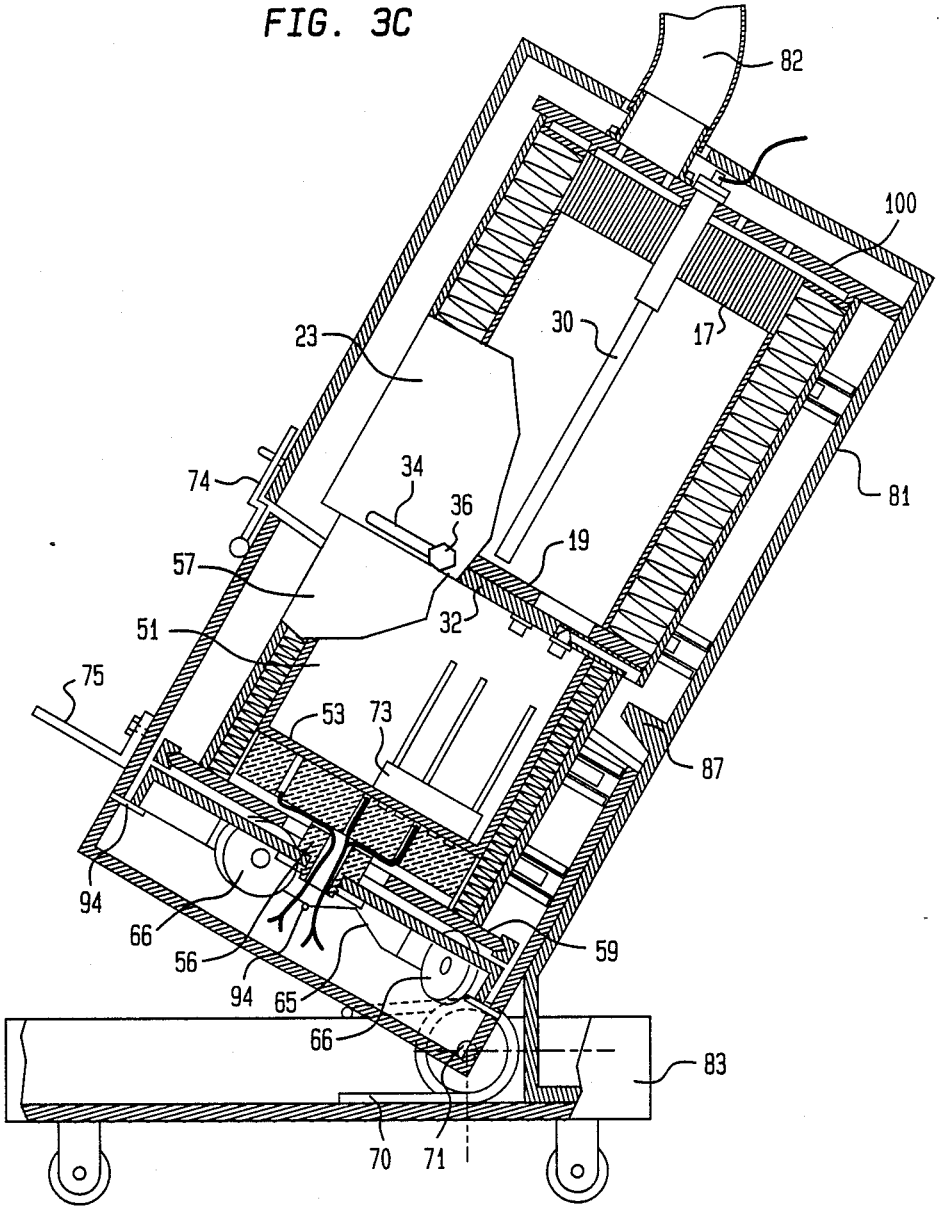

The oxidizer 11 will also begin to rotate with the pyrolyzer 12 when the gear-motor 60 is energized. The teeth 50 on the shell 57, being meshed with the recesses 52, will initially drive only the plate 32. Plate 32 will rotate counterclockwise as viewed in FIG. 7 as the bolts 36 slide in slots 34. When the bolts 36 reach the ends of the slots 34, the drive platform 64 will rotate in the opposite direction as the result of a reaction torque caused between the gear-motor 60, which is mounted on the platform 64, and the oxidizer 12 which is restrained by resting on ledge 87 and by friction with the seals on plate 100. As viewed in FIG. 9, the platform 64 will now rotate clockwise until the right edge of arm 62 contacts shoulder 97 of stepped slot 95. The position of arm 62 is shown in phantom in FIG. 9. As the drive platform 64 moves from the center position, as shown in FIG. 3B and in solid line in FIG. 9, to the final clockwise positions, as shown in FIG. 3C and in phantom in FIG. 9, the platform 64 will be raised as a result of the ramps 65 sliding up on the pins 94. As the platform 64 is raised, the pyrolyzer 12, the oxidizer 11 and the plate 100 will also be raised inside the shrouds 81, 91. As seen in FIG. 3C, the shell 23 will no longer be supported by the ledge 87, and the bolt 36 will be located in the counter clockwise end of slot 34 looking downward. It is also noted that in this position, the plate 32 is oriented with respect to plate 19 such that the openings 42 and metering jets 44 are moved into alignment with the slots 28 as shown in FIG. 6B (pyrolysis mode). The oxidizer 11 will now rotate as a unit, including the plates 32, 19, the shell 23, the insulator 21, the chamber 13 and the honeycomb 17. The plate 100, being held in place by the inside surface of shroud 81, will not rotate. The heater rod 30 and the duct 82 are fixed to plate 100 only and will not rotate.

As the gear-motor 60 continues to drive the pyrolyzer 12 and oxidizer 11, sufficient heat is generated by coil 70 so that the waste is pyrolyzed, causing the chamber 15 to supply combustible vapors to the chamber 13 via the passageways 46 in jets 4. While the combustible vapors exit jets 44, primary air will be drawn into the chamber 13 via the slot 40 by fan 78. Secondary air will also be drawn into the chamber 13 through the openings 84 of plate 100 and the honeycomb 17. This flow of secondary air into chamber 13 is also produced by the induced draft of the fan 78. The products of reaction in chamber 13 flow through honeycomb 17 to exhaust duct 82 via openings 86 and fitting 80. Meanwhile, the shroud 81 will guide air that enters its lower end up past the outer surface of shell 23 and plate 100. This air will be heated during its travel and will be preheated further as it moves down through the honeycomb 17. This preheating of the combustion air materially reduces the heat required from heater rod 30 to reach a given temperature and allows a substantial excess of air over that required for combustion to be employed. As such, the chamber 15 is maintained in an oxidizing condition for rapid destruction of the pyrolysis vapors. In a typical implementation, the air flow and temperature in chamber 15 may be designed to accomplish a residence time of approximately one to two seconds at temperatures above 1000 C. to completely destroy any organic materials in the pyrolysis vapor.

Because the entire assembly is rotated about its axis, regenerative heat recovery is achieved in honeycomb 17 between hot exhaust gases flowing to duct 82 and air flowing into chamber 13 through honeycomb 17. The honeycomb 17 may be implemented in a typical unit as a ceramic body containing a number of parallel passages approximately 2 mm x 2 mm. Cercor ceramic manufactured by Corning Glass may be used. In a typical embodiment, the rod 30 will be designed to reach temperatures in excess of 1000° C. A commercial silicon carbide Globar heater may be used for this purpose.

At a predetermined temperature in pyrolysis chamber 15, the pyrolysis process is stopped and the charred contents of chamber 15 are oxidized. One preferred method of determining this point is to measure the temperature just below the chamber 15 with a conventional thermocouple 67 embedded in ceramic base 72. Typically, when the temperature, as measured by thermocouple 67, reaches 500 C., pyrolysis of the waste material is usually complete.

Figure 9:
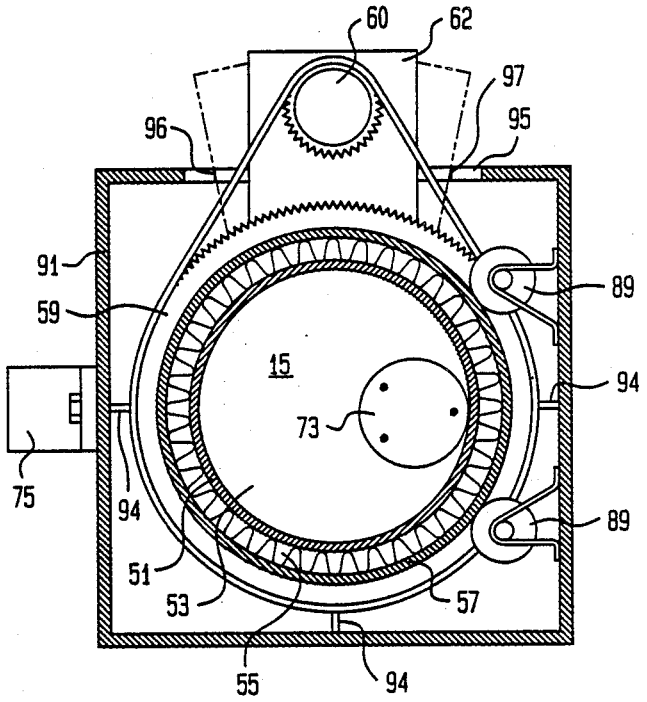
FIG. 9 is a cross section of the preferred embodiment taken on the line 9—9 of FIG. 3B looking in the direction of the arrows.

Next the gear-motor 60 is reversed causing the pyrolyzer 12 to turn clockwise and the drive platform 64 to turn counterclockwise. This action first causes the drive platform 64 to drop with respect to pins 94, returning it to the center position as shown in FIGS. 3A, 3B. The shell 23 also drops from the raised position to rest again on ledge 87. With the weight now removed from plate 32, it will be free to be driven by teeth 50 in the clockwise direction as viewed in FIG. 7. Plate 32, when rotated, will cause bolts 36 to slide in slots 34. When the bolts 36 reach the clockwise end of slots 34, the plate 32 and plate 19 will be oriented in the position shown in FIG. 7. At this point, with the slots aligned to communicate between chambers 13 and 15, a reaction torque will cause the drive platform 64 to rotate counterclockwise forcing the ramps 65 to ride up on pins 94 to the position shown in FIG. 3D. The arm 62 will stop the rotation of platform 64 when it encounters shoulder 96 (FIG. 9). Plate 32 will now be oriented with respect to plate 19 in the position shown in FIG. 6A (oxidation mode).

Figure 3D:
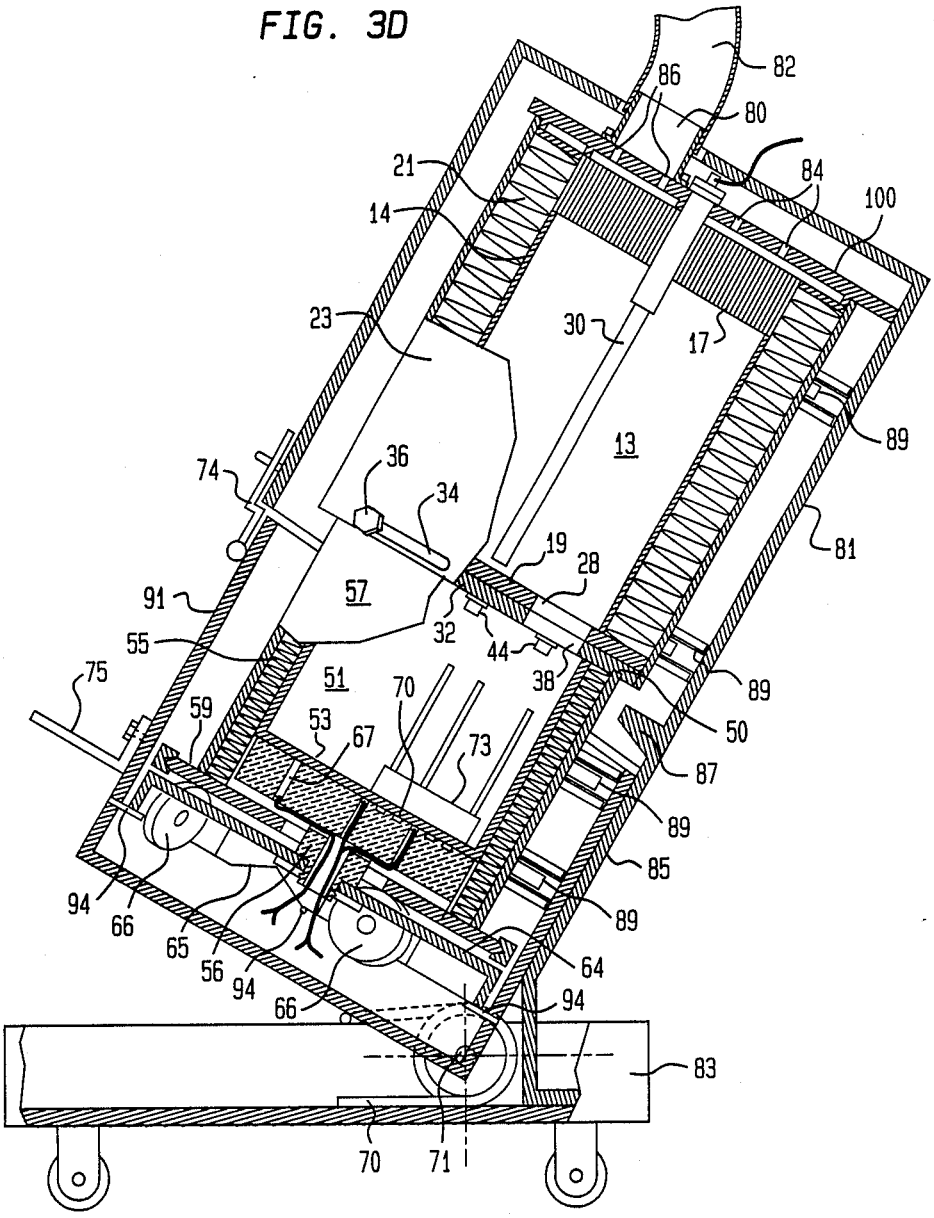
Figure 6A:
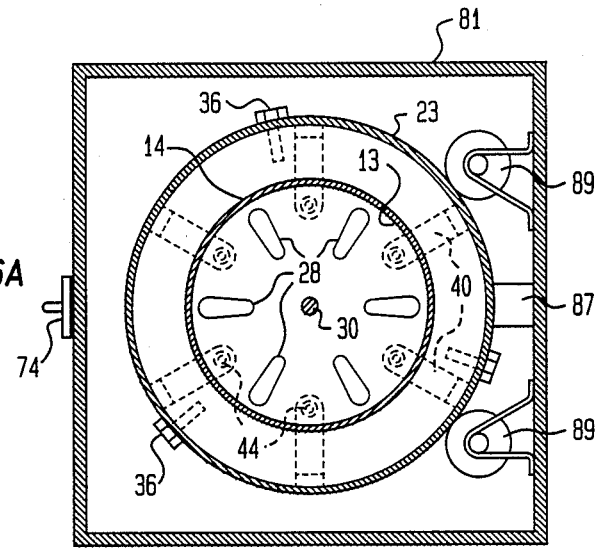
FIG. 6A is a cross section of the preferred embodiment in the oxidation mode taken on the line 6—6 of FIG. 3B looking in the direction of the arrows.
Figure 6B:
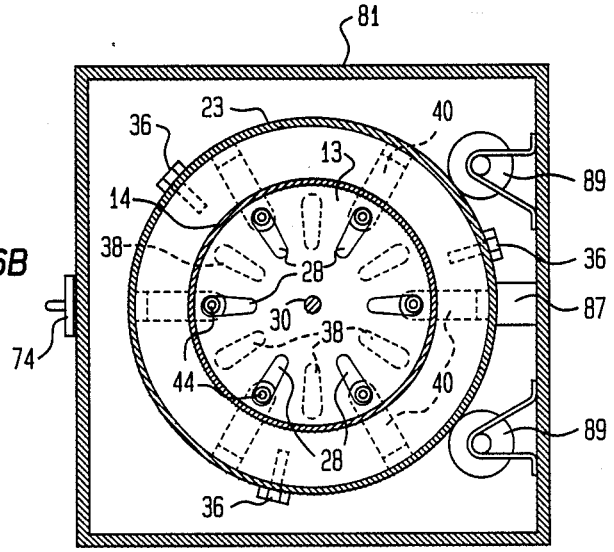
FIG. 6B is a view similar to the view of FIG. 6A but depicting a different position of the device in the pyrolysis mode.

As can be seen in FIGS. 3D and 6A, when the slots 28 in plate 19 are superimposed on the slots 38 in plate 32, hot air will directly enter the chamber 15 from chamber 13. As the pyrolyzer 12 continues to rotate clockwise, the air entering chamber 15 via slots 28, 38 will oxidize the charred solids. The stirrer 23 will assist this oxidation process. The oxidation process in the pyrolyzer 12 will continue until the char therein is entirely consumed and reduced to a sterile ash, typically at a temperature of approximately 600°–750 ° C. as measured by thermocouple 67. Any gaseous products will be oxidized in chambers 15 and 13. Typically, the process could take three hours. During this period, stirrer 73 will be tumbling in chamber 15 to break up the char and ash and improve heat transfer. When oxidation is complete, the gear-motor 60 is again reversed momentarily to return the platform 64 to the center position shown in FIG. 3B. Finally, all power to the disposal unit 10 is shut off and the unit is cooled down ready for another load.

The pyrolysis chamber 15 is preferably implemented with stainless steel walls coated on the inside surface with a ceramic material to provide a white surface appearance following oxidation. The insulators 21 and 55 may be made of ceramic material or packed fibrous insulation such as Kaowool manufactured by Babock and Wilcox Ceramics. The plates 19 and 32 are preferably made of a material having a minimal thermal expansion coefficient to provide for a reasonably air tight seal between plates 29 and 32 during the pyrolysis process. Ceramic materials such as lava and other machineable ceramics such as porous silica are appropriate materials to be used in plate 19. Plate 32 can be made of ceramic or a heat resisting metal such as stainless steel. Molded porcelain ceramics can also be used. The wall of chamber 13 is preferably a ceramic tube of high temperature material such as Mullite. The shells 23, 57 may be a thin walled metal tubes. The plate 100 and lateral wall 25 may be formed from stainless steel plate.

It is also noted that the honeycomb 17, acting as a regenerative heat exchanger, is also effective at trapping particulate material and exposing it to further oxidation. This process is enhanced by the effect of thermophoresis which tends to drive fine particles in the hot exhaust gas toward the cool surface of the regenerative matrix of honeycomb 17, trapping them there until the next cycle of air admission at which time they are either combusted or blown back into the chamber 13.

In burning polymers containing chlorine, such as polyvinylchloride, the chlorine is normally converted quantitatively to HCl vapor. A bed of basic absorbent such as dolomite may be installed ahead of fan 78 to absorb any HCl produced. A charcoal bed may also be added ahead of fan 78 to trap minor amounts of volatile organics and odorants which bypass the oxidizer 11. A filter may also be installed in the exhaust duct 82 to trap any residual particulates which escape the thermophoresis effect in the honeycomb 17.

In principle, this absorber-filter assembly could provide for completely free standing, non-vented operation. In practice, it will probably be desirable to vent the exhaust with a low temperature aluminum/plastic duct similar to a clothes dryer vent to dispose of the heat and humidity produced by combustion.

Obviously many modifications and variations of the present invention are possible in the light of the above teachings. It is therefore to be understood that within the scope of the appended claims, the invention may be practiced otherwise than as specifically described.

What is claimed is:

1. A waste disposal apparatus comprising:
a pyrolyzing chamber defining an enclosed space;
means for heating the enclosed space to a temperature sufficient to pyrolyze waste material contained therein;
an oxidizing chamber mounted adjacent the pyrolyzing chamber and having means for oxidizing combustible vapors introduced therein; and
a movable barrier mounted between said chambers and having at least two stable positions, said barrier when in a first stable position having means for preventing air from entering said pyrolyzing chamber wile permitting vapors in said space to pass into said oxidizing chamber, and when in said second stable position having means for permitting air to enter said pyrolyzing chamber for oxidizing pyrolyzed waste material contained in said space.

2. The apparatus of claim wherein said barrier includes means for permitting air to enter said oxidizing chamber and mix with said vapors when in the first stable position.

3. The apparatus of claim 2 wherein said barrier includes at least one jet nozzle having a narrow channel in communication with said chambers whereby vapors in said pyrolyzing chamber will be discharged into said oxidizing chamber in the first stable position.

4. The apparatus of claim 2 further including a drive means for moving said pyrolyzing chamber to agitate waste material contained therein.

5. The apparatus of claim 4 wherein said drive means rotates said pyrolyzing chamber.

6. The apparatus of claim 5 further including a stirrer mounted in said pyrolyzing chamber.

7. The apparatus of claim 6 wherein said stirrer includes an irregularly shaped, weighted object freely placed in said pyrolyzing chamber.

8. The apparatus of claim 5 wherein said pyrolyzing chamber includes coupling means for moving said barrier into said two stable positions.

9. The apparatus of claim 8 wherein said drive means rotates said pyrolyzing chamber in at least two different directions and wherein said barrier is moved into different stable positions for different rotations of said pyrolyzing chamber.

10. The apparatus of claim 9 wherein said barrier includes a movable plate having at least one jet nozzle and one opening formed therein.

11. The apparatus of claim 10 wherein said oxidizing chamber includes means to cause said oxidizing chamber to rotate with said movable plate when said barrier is in said stable positions.

12. The apparatus of claim 11 further including a heat exchanger mounted in said oxidizing chamber having means for preheating additional air entering said oxidation chamber.

13. A waste disposal apparatus comprising:
a pyrolyzing chamber defining an enclosed space;
means for heating the enclosed space;
an oxidizing chamber mounted adjacent the pyrolyzing chamber and having walls with openings therein;
means for heating the oxidizing chamber;
a movable plate mounted between said chambers having at least one jet nozzle and one opening formed therein; and
means for moving said plate with respect to the walls of the oxidizing chamber between a first position to align one of the wall openings with said jet nozzle and a second position to align said one of the wall openings with the openings formed in said plate.

14. The apparatus of claim 13 wherein said plate includes means for permitting air to enter said oxidizing chamber and mix with said vapors when in the first position.

15. The apparatus of claim 14 further including a drive means for moving said pyrolyzing chamber to agitate waste material contained therein.

16. The apparatus of claim 15 wherein said drive means rotates said pyrolyzing chamber.

17. The apparatus of claim 16 further including a stirrer mounted in said pyrolyzing chamber.

18. The apparatus of claim 17 wherein said stirrer includes an irregularly shaped, weighted object freely placed in said pyrolyzing chamber.

19. The apparatus of claim 16 wherein said pyrolyzing chamber includes coupling means for moving said plate into said first and second positions.

20. The apparatus of claim 19 wherein said drive means rotates said pyrolyzing chamber in at least two different directions and wherein said plate is moved into different positions for different rotations of said pyrolyzing chamber.

21. The apparatus of claim 20 wherein said oxidizing chamber includes means to cause said oxidizing chamber to rotate with said movable plate when said plate is in said first and second positions.

22. The apparatus of claim 21 further including a heat exchanger mounted in said oxidizing chamber having means for preheating additional air entering said oxidizing chamber.

23. A waste disposal apparatus comprising:
a pyrolyzing chamber defining an enclosed space;
means for heating the enclosed space;
an oxidizing chamber;
means for heating said oxidizing chamber;
plate means mounted between said pyrolyzing chamber and said oxidizing chamber for selective communication between said two chambers; and
drive means for rotating said pyrolyzing and oxidizing chambers about a common axis.

24. The apparatus of claim 23 further including a stirrer means located in said pyrolyzing chamber and wherein said stirrer means comprises a freely moveable, irregularly shaped, weighted object.

25. The apparatus of claim 24 further comprising a regenerative heat exchanger means located in said oxidizing chamber for preheating air entering said apparatus with exhaust heat exiting said apparatus.

26. The apparatus of claim 25 wherein said means for heating said oxidizing chamber comprises an electrical heating element extending along said common axis into said oxidizing chamber.

27. A waste disposal apparatus comprising:
a pyrolyzing chamber having a major axis and defining an enclosed space;
means for heating said enclosed space;
an oxidizing chamber also having a major axis which is coincidental with and parallel to the major axis of said pyrolyzing chamber;
means for heating the oxidizing chamber;
means for rotating said pyrolyzing and oxidizing chambers about said major axis; and
mode changing means located between said pyrolyzing and oxidizing chambers to permit oxidation to take place in said pyrolyzing chamber after materials have been pyrolyzed in said pyrolyzing chamber.

28. A waste disposal method comprising:

providing a pyrolyzing chamber and an oxidizing chamber in close proximity to each other;

pyrolyzing, in substantially the complete absence of air, waste material in said pyrolyzing chamber;

directing fumes from said pyrolyzing chamber and air into said oxidizing chamber;

oxidizing said fumes in said oxidizing chamber with additional air; and after pyrolyzing said waste, directing air into said pyrolyzing chamber to oxidize the pyrolyzed waste therein.

29. The method of claim 28 further including rotating said pyrolyzing chamber and said oxidizing chamber about a common axis.

30. The method of claim 28 further including stirring the waste material in said pyrolyzing chamber.

31. The method of claim 28 further including preheating said additional air entering said oxidizing chamber.

32. The method of claim 31 wherein heat from hot, oxidized gases leaving said oxidizing chamber is used to preheat said additional air.

* * * * *